US005327948A

United States Patent [19]

Blakemore

[11] Patent Number: 5,327,948

[45] Date of Patent: Jul. 12, 1994

[54] SUPPLY SYSTEM

[75] Inventor: John J. Blakemore, Aldridge, United Kingdom

[73] Assignee: Rojac (Patterns Division) Limited, Birmingham, England

[21] Appl. No.: 22,281

[22] Filed: Feb. 25, 1993

[30] Foreign Application Priority Data

Feb. 26, 1992 [GB] United Kingdom ..... 9204071
Dec. 19, 1992 [GB] United Kingdom ..... 9226519

[51] Int. Cl.[5] ..... B67D 1/16

[52] U.S. Cl. ..... 141/86; 141/88; 141/311 A; 141/82; 137/312; 222/108

[58] Field of Search ..... 141/86, 87, 88, 82, 141/311 A; 137/312; 222/108

[56] References Cited

U.S. PATENT DOCUMENTS

| | | | |
|---|---|---|---|
| 3,820,577 | 6/1974 | Sidebottom | 141/88 X |
| 4,416,194 | 11/1983 | Kemp | 141/82 X |
| 4,685,592 | 8/1987 | Vanderjagt | 222/148 |
| 4,754,786 | 7/1988 | Roberts | 141/286 X |
| 4,796,677 | 1/1989 | Nice | 141/88 |
| 4,988,020 | 1/1991 | Webb | 222/108 X |
| 4,997,012 | 3/1991 | Kuziw | 141/1 |
| 5,005,615 | 4/1991 | McGarvey | 141/86 X |
| 5,016,689 | 5/1991 | McGarvey et al. | 141/86 X |
| 5,088,530 | 2/1992 | Harp | 141/86 |
| 5,137,064 | 8/1992 | McGarvey et al. | 141/86 X |
| 5,203,386 | 4/1993 | Harp | 141/86 |

FOREIGN PATENT DOCUMENTS

| | | | |
|---|---|---|---|
| 2544699 | 4/1993 | France . | |
| 2-108496 | 4/1990 | Japan . | |
| 700677 | 12/1979 | U.S.S.R. . | |
| 270417 | 5/1927 | United Kingdom | 141/88 |

*Primary Examiner*—Ernest G. Cusick
*Attorney, Agent, or Firm*—Jacobson, Price, Holman & Stern

[57] ABSTRACT

A supply system for supplying a liquid reagent from a storage tank to a dispensing head, for example a foam molding head, includes a tank (12) having a lid (14) moveable between a closed position and an open position affording access to the interior of the tank and the underside of the lid, a pump (26) and a distribution valve (36) disposed on the underside of the lid, and a drive motor (27) for the pump and an actuator (37) for the valve on the exterior of the lid. Any leakage occuring in use from the pump and/or the valve takes place in the tank and leaked material remains inside the tank.

16 Claims, 3 Drawing Sheets

SUPPLY SYSTEM

BACKGROUND OF THE INVENTION

This invention relates to a supply system particularly but not exclusively a supply system wherein hazardous chemicals in liquid form can be supplied from a storage tank of the system to associated dispensing equipment.

Known supply systems include a storage tank in which the chemical is stored temporarily before dispensing, pipework leading from the storage tank to the dispensing equipment, and a pump for pumping the chemical through the pipe-work, the pump being located at a position between the tank and the dispensing equipment.

Other equipment, for example, a diverter valve or other valve structure and monitoring sensors may be positioned in the pipe-work between the tank and the dispensing equipment. Pumps, diverter valves, and similar devices using moving parts accessible to the liquid chemical are prone to leakage arising from seal wear or seal failure, and this problem is exacerbated by chemicals which are aggressive to the seal material or not compatible with seal lubricants. Naturally chemical leaks into the working environment are undesirable and where certain chemicals are concerned, such leaks cannot be tolerated owing to the toxicity of the chemical and the risks to personnel in the area. In such circumstances, not withstanding the fact that the pump or valve may be capable of continuing to operate satisfactorily, the presence of even a minute leak will necessitate shut-down of the supply system and perhaps evacuation of personnel until the leak can be rectified.

BRIEF SUMMARY OF THE INVENTION

It is an object of the present invention to minimize the above difficulties.

A supply system according to the present invention comprises a storage tank for containing a supply of liquid to be dispensed, and pump means for pumping said liquid in use from the tank to associated dispensing equipment, the pump being housed within the confines of the tank so that should pump leakage occur then the leaked liquid will be returned to the supply.

Preferably the tank includes a lid movable relative to the remainder of the tank between a closed position in which the tank is sealed and an open position in which the interior of the tank and the underside of the lid are accessible, said pump being positioned on the underside of the lid.

Desirably the pump is above the intended highest liquid level in the tank when the lid is in its closed position.

Preferably the pump is motor driven, the motor being positioned on the exterior of the tank.

Preferably a lifting mechanism is provided for moving the lid from its closed position to its open position relative to the remainder of the tank. Desirably the lifting mechanism is capable of supporting the lid in its open position to facilitate access to components positioned on the underside of the lid.

Preferably, the supply system further comprises a filter through which the liquid passes before passing through the pump. The filter is preferably mounted upon the lid.

Desirably, the supply system further comprises a heat exchanger through which the chemical passes before entering the storage tank. The heat exchanger is conveniently carried by the lid.

Preferably, the supply system further comprises a distribution valve positioned within the storage tank, the inlet of the valve communicating with the outlet of the pump, and the valve being driven by a motor positioned outside of the tank. Preferably, the valve is carried by the lid of the storage tank.

Desirably said distribution valve is a three-way valve.

One outlet of the valve is preferably in communication with the inlet of the heat exchanger thereby providing a recirculation path, the remaining outlets of the valve communicating in use with respective dispensing means.

Conveniently, the storage tank includes means for raising the pressure within the storage tank to a level greater than atmospheric pressure. The storage tank is preferably provided with means for reducing the pressure within the storage tank when the pressure within the storage tank exceeds a predetermined level.

Preferably the casing of the pump is supplied with liquid at a pressure not less than tank pressure.

Desirably said pump casing communicates with the return line whereby liquid is returned to the tank from the dispensing means.

BRIEF DESCRIPTION OF THE DRAWINGS

The invention will further be described by way of example with reference to the accompanying drawings, wherein.

DETAILED DESCRIPTION

Figure 1:
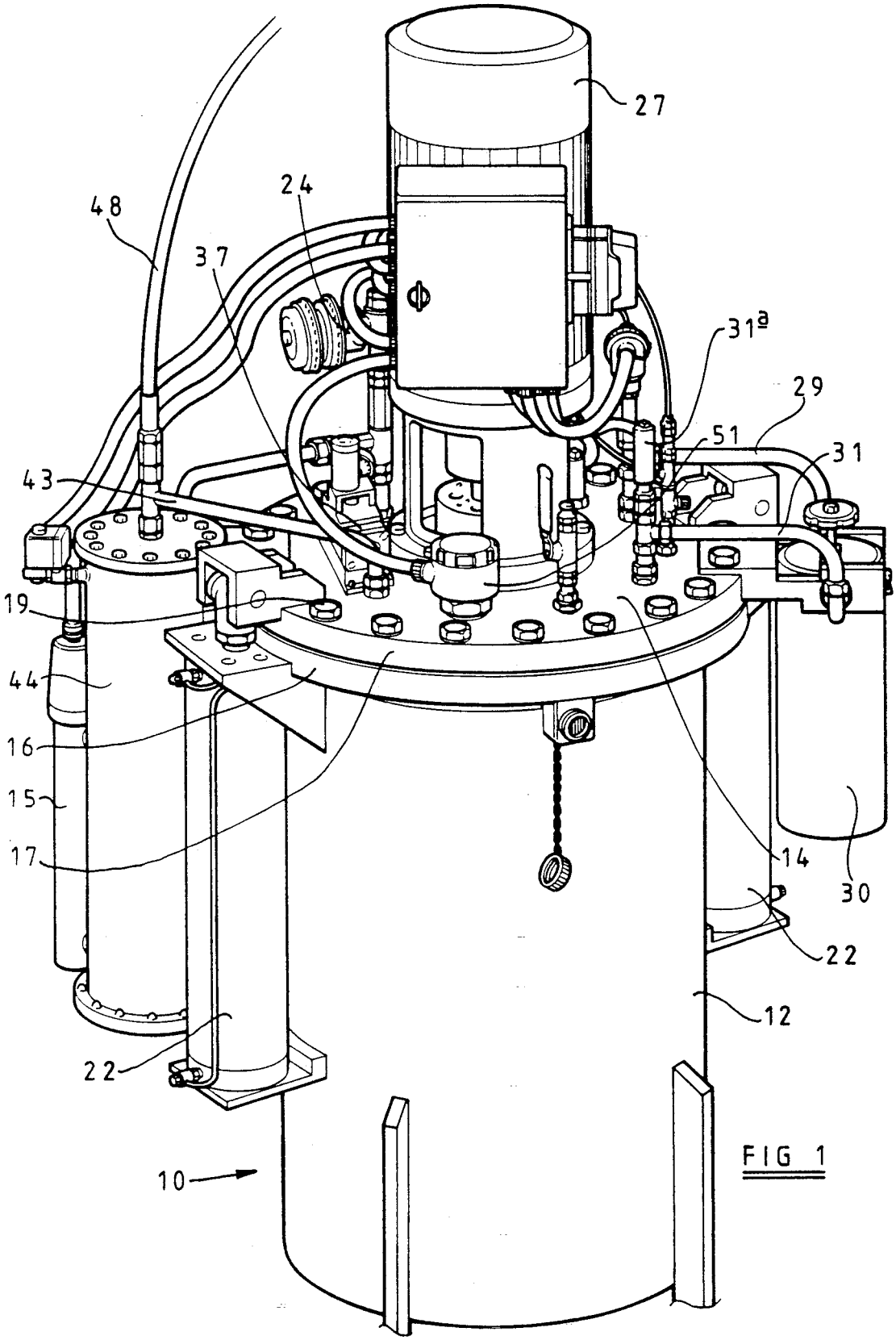
FIG. 1 is a perspective view of a supply system according to an embodiment of the present invention shown with the tank thereof closed.
Figure 2:
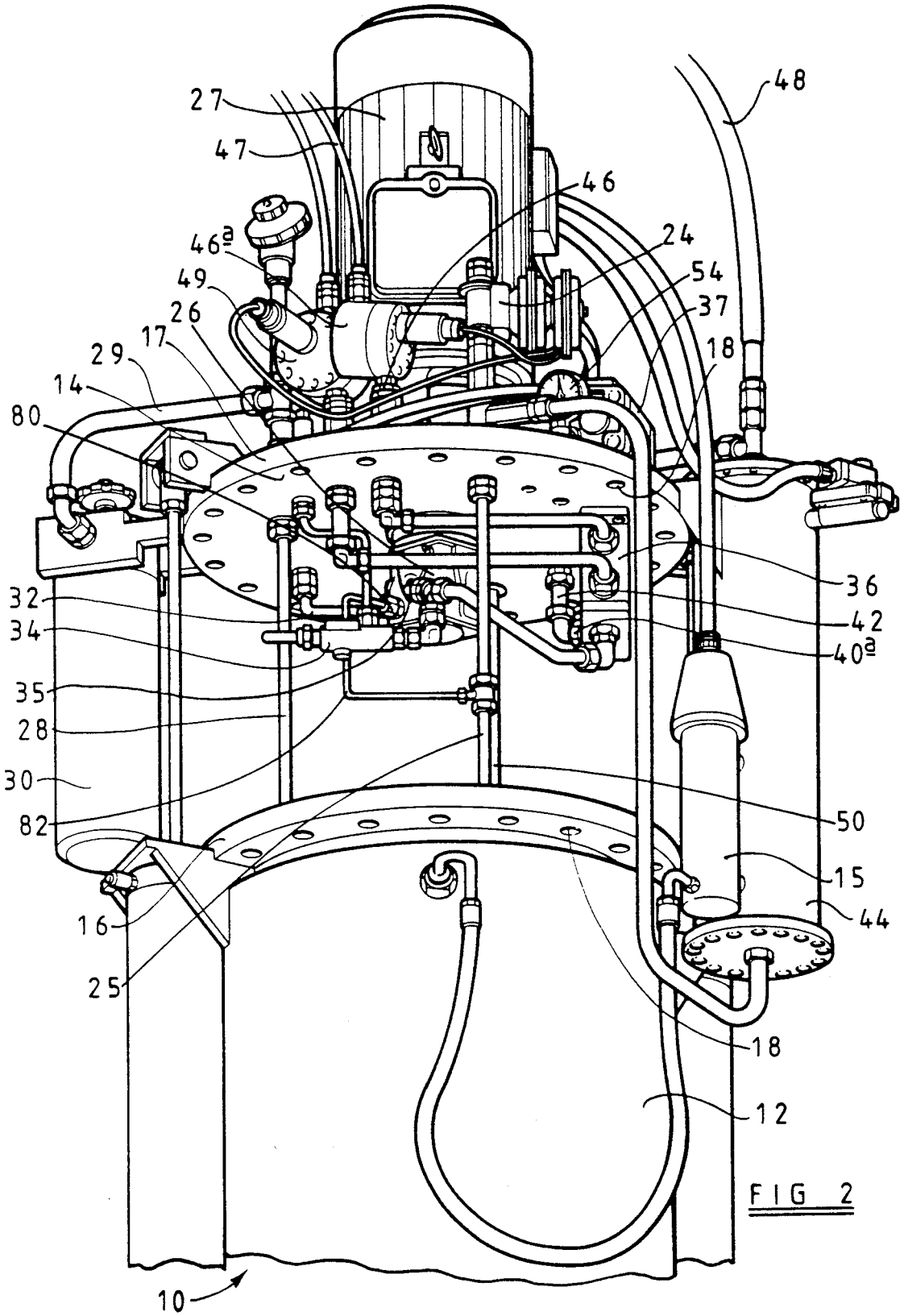
FIG. 2 is a view similar to FIG. 1 but from the reverse side of the supply tank and with the lid in its open position.

The supply system illustrated in the drawings can be utilized in the supply of a wide range of liquids but in a particular application the system illustrated is one of two substantially identical systems for supplying respectively two liquid reagents of a foam molding compound for the production of vehicle seat cushions and squabs, domestic furniture cushions and the like. The reagents foam when mixed and so are dispensed separately to be mixed as they are injected together into the mold. One of the reagents, polyol (Polyether Polyol containing Styrene-Acrylonitrile Copolymer dispersion), is relatively innocuous but the other, isocyanate (Toluenediisocyanate and/or Diphenylmethanediisocyanate) is particularly toxic and so is subject to stringent handling restrictions. Since the two systems are substantially identical only one will be described.

Referring to the drawings, the supply system includes a liquid chemical (reagent) storage tank 10 in the form of a hollow generally cylindrical steel tank body 12 and a circular lid 14, the lid 14 being moveable between a lowered position in which the lid 14 is in contact with the body 12 and closes the body 12, and a raised position in which the lid 14 and the body 12 are spaced apart.

The abutting ends of the body 12 and lid 14 have respective apertured rims 16, 17 the apertures 18 of which receive respective nut and bolt fasteners 19 whereby the lid can be clamped in gas tight sealing engagement with the body 12 to close the tank.

The lid 14 is also coupled to the body 12 of the tank 10 by means of two pneumatic rams 22 positioned on opposite sides of the body 12. The rams 22 are arranged such that they can be used to raise the lid 14 relative to the tank body after removal of the fasteners, and support the lid 14 when the lid 14 is in its raised position. When the lid 14 is in its raised position, the interior of the body 12 of the tank 10 and the underside of the lid 14 are readily accessible.

The liquid reagent is stored in the tank 10 under pressure, the pressure being maintained by means of compressed air admitted to the tank 10 through an air inlet pipe. Certain reagents may require an elevated storage temperature for example to avoid crystallization and so the tank may have an insulated outer jacket and may be provided with an internal heater.

The temperature within the tank 10 may also be raised or lowered by passing hot or cold water through a water jacket formed in or around the wall of the body 12 of the tank 10. The water may be heated before being passed through the jacket by passing it through a heater 15 mounted on the outside of the tank 10 and attached to the lid 14 of the tank 10.

The tank 10 can be filled to a predetermined maximum level below the level of the lid by pumping the reagent from, for example, a bulk, heated storage reservoir to the tank 10 by way of a tank inlet port 24 mounted on the external surface of the lid 14. The inlet port 24 communicates with a pipe 25 passing through the lid 14 and extending substantially to the bottom of the tank 10.

A dispensing pump 26 is attached to the underside of the lid 14, and arranged such that a drive shaft for the pump 26 extends upwardly through a central aperture in the lid to cooperate with an electric drive motor 27 mounted on the upper surface of the lid 14.

The pump 26, which may for convenience be a swash plate pump set to near maximum displacement, is arranged to draw liquid from adjacent the bottom of the tank 10 through a pipe 28. The pipe 28 extends through the lid 14, and includes an external region 29 which communicates with the inlet of a filter 30 positioned on the exterior of the tank 10 and carried by the lid 14 of the tank 10. The liquid then passes along a filter return pipe 31 which extends through the lid 14 and communicates with a pipe 32 positioned inside the tank 10 and connected to the inlet 33 of the pump 26. The filter 30 removes undesirable particles from the liquid before it passes through the pump 26 to be dispensed. The size of the particles filtered out of the reagent may be controlled by use of appropriate filter elements. The filter 30 is positioned outside of the tank 10 for ease of cleaning or replacement of the filter element. A pressure sensor 31*a* measures the pressure of the liquid in the filter return pipe 31 and comparison of this pressure with the pressure in the pipe 29 (or the tank 12) indicates the state of the filter. For example a large pressure drop across the filter 30, indicates that the filter 30 is blocked, or partially blocked, and needs cleaning or replacing.

A microprocessor control unit receives signals from the sensor 31*a* and other sensors of the apparatus and effects control of the apparatus. Thus when the signal from the sensor 31*a* is indicative of low pressure the control unit provides an audible and/or visible "filter blocked" warning. Similarly if the signal derived from the sensor 31*a* indicates a pressure in excess of a predetermined value a "tank over-pressure" warning is given.

The air pressure applied to the tank is conveniently controlled externally but if desired control could be effected by the control unit of the apparatus. A mechanical "blow-off" valve on the lid 14 of the tank 10 vents the tank to atmosphere at a pressure in excess of that at which the "tank over-pressure" warning is given by the control unit.

Pressure sensors monitor the pump output pressure at different locations in the output line, for example adjacent the pump outlet 35 and adjacent the distribution valve (to be described later) outlet. If the pressure at either sensor rises above a predetermined safe value the microprocessor control unit deenergizes the pump drive motor. In addition a mechanical safety valve 34 (a blowoff valve) is positioned within the tank 10 and communicates with the outlet 35 of the pump 26. At a pressure in excess of that at which the control unit should have deenergized the pump motor the valve 34 will open to allow the output from the pump to flow directly back into the tank.

Figure 3:
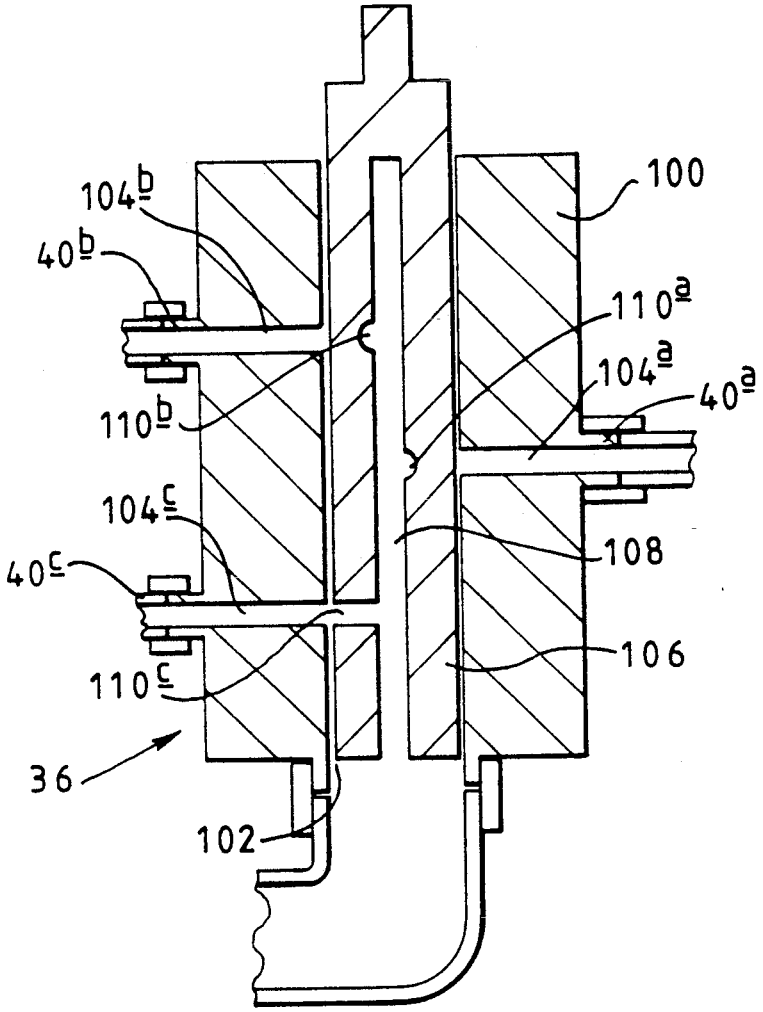
FIG. 3 in a cross-sectional view of a three way valve for use in the supply system of FIG. 1.

The outlet 35 of the pump 26 is also connected to the inlet of a three way distribution valve 36. The three way valve 36 is positioned within the tank 10 on the underside of the lid 14, and is controlled by an air or electrically powered rotary actuator 37 positioned outside of the tank 10. The three way valve 36, as shown in FIG. 3, comprises a steel block 100 having a central bore 102. Three outlet passages 104*a*, 104*b*, 104*c* are formed in the block 100 each being in communication with the central bore 102 and extending radially outwardly therefrom. The outlet passages 104 are axially spaced along the bore 102 and are angularly spaced from one another while lying in parallel planes transverse to the bore 102.

A cylindrical rod 106 is rotatably received as a close sliding fit in the bore 102 and is rotatable therein under the control of the actuator 37. The fit of the rod 106 in the bore 102 is such that little or no leakage occurs between the rod 106 and the block 100. The rod 106 is provided with an axial bore 108 and three radial apertures 110*a*, 110*b*, 110*c* each communicating with the axial bore 108. Each of the three apertures 110 is arranged such that it communicates with a respective one of the three passages 104 formed in the block 100 when the rod 106 is in a predetermined angular position. The outlet 35 of the pump 26 communicates with the axial bore 108 of the rod 106. The actuator 37 is arranged to be able to rotate the rod between three predetermined angular positions in each of which a respective one of the three apertures 110 in the rod 106 communicates with a respective one of the outlet passages 104 of the block 100. When the three way valve is as positioned in FIG. 3, aperture 110*c* of the rod 106 communicates with passage 104*c* of the block 100. Rotation of the rod 106 within the block 100 by a predetermined amount will cause a different one of the apertures 110 in the rod 106 to align with a passage 104 in the block 100. Thus the liquid can be directed to different locations.

The first and third positions of the rod 106 are determined by opposite limit positions of the actuator 37 which in turn can be adjusted and maintained by mechanical stops. In order accurately to define the second position the output shaft of the actuator drives a rotary cam or abutment member which can abut a movable stop. When the second position of the rod 106 is required a control mechanism causes operation of the actuator 37 and simultaneously causes movement of the movable stop into the path of movement of the rotary cam or abutment member whereby movement of the actuator beyond the second position is physically prevented. However when the second position of the rod 106 is not required the stop is withdrawn so that movement of the actuator output shaft to either limit position is not impeded. An internal control mechanism of the actuator 37 may prove sufficiently accurate to define the second position of the output thereof, in which case the moveable stop and cam or abutment member may simply be employed as a safety mechanism.

Each of the passages 104 of the block 100 terminates at a respective outlet port 40*a*, 40*b*, 40*c*. A first of the outlet ports 40*a* is in communication with a recirculation pipe 42 within the tank, the pipe 42 communicating through the lid with a pipe 43 outside of the tank 10. The pipe 43 is connected to an inlet of a heat exchanger 44 which, like the filter 30, is positioned beside the tank 10 and is attached to the lid 14 of the tank 10 so that the heat exchanger 44 is raised or lowered when the lid 14 is raised or lowered. The heat exchanger 44 is used to either increase or decrease the temperature of the liquid reagent flowing through it so as to achieve and maintain a predetermined temperature of the reagent stored within the tank 10, the outlet of the heat exchanger 44 being connected to the inlet port 24 so that the reagent can be pumped around a recirculation path including the heat exchanger.

The remaining two outlet ports 40*b*, 40*c* of the three way valve 36 direct the reagent along similar routes. The outlet port 40*b* of the three way valve is connected to a first distribution outlet 46 of the tank. From the first distribution outlet 46, which is on the exterior of the lid 14, the reagent flows through a flow sensor 46*a* and a flexible pipe 47 to a remote foam head (not shown) under the pressure generated by the pump 26. In the foam head, a predetermined quantity of the reagent is mixed with an appropriate quantity of the reagent coming from the second supply system and the mixture of the reagents is then discharged into a mold where it foams to fill the mold and then cures. Metering of the desired quantities of reagent is performed at the foam head by controlling opening times of valves allowing the reagents to flow from the pressure lines into a mixing chamber. When a valve is closed the reagent is not stagnant in the pipe 47 and is returned to the tank by way of a return pipe 48 coupled at its tank end to the inlet of the heat exchanger 44. The flexibility of the pipes 47, 48 facilitates movement of the foam head as necessary to dispense mixed reagents into moving molds on a conveyor. Conveniently a robot arm device carries the foam head and ensures that reagents are dispensed as needed at predetermined areas of each mold.

The second of the remaining outlet ports 40*c* directs the chemical to a second distribution outlet 49 on the lid 14 from where it flows to an identical foam head to that described above. Thus the supply system can supply reagent to either of a pair of foam heads dependent upon the setting of the three way valve.

The casing of the pump 26 includes a drain aperture 80 providing access to the interior of the casing and a pipe 82 connects the drain aperture 80 to the pipe 25 through which liquid reagent is arranged to return to the tank as described above. In use, the reagent is dispensed from the pump to a mixing head under pressure. When the mixing head is not delivering the reagent into, for example, a mold the reagent is circulated past the head and is returned to the tank by way of return pipe 48, heat exchanger 44, and the pipe 25, at a pressure greater than the pressure within the tank. Naturally if the three-way valve 36 is in its operative position supplying pump output to the port 40*a* then the lines to the mixing head are by-passed and the flow is directed through the heat exchanger to the port 24 and pipe 25.

The provision of the pipe 82 in communication with the drain aperture 80 of the pump 26 and the pipe 25 results in a flow of the reagent to the casing of the pump 26 at a pressure which is greater than (or at least equal to) that in the tank. Since the pressure within the pump casing is at least equal to that in the tank, there is no tendency for air to enter the casing of the pump 26, and where the pressure within the casing is greater than the pressure within the tank as will always be the case in normal operating conditions, there exists a pressure gradient resulting in leakage of the liquid reagent from the pump casing into the tank rather than ingress of air into the pump casing from the tank. The absence of air in the pump casing ensures that the liquid reagent dispensed by the apparatus does not suffer from air inclusion and that the efficiency of the pump is not impaired.

The tank is provided with a depth sensor 51, conveniently an elongate capacitive probe 50, extending substantially to the bottom of the tank 10. The electrical capacitance of the probe 50 varies in accordance with the length of the probe which is immersed in the reagent and so the capacitance of the probe provides a measure of the depth of reagent within the tank 10. By arranging for the output of the depth sensor 51 to be fed into a computer, it is possible automatically to monitor the level of reagent within the tank 10 and automatically to replenish the reagent supply in the tank when it falls below a predetermined level.

The tank is provided with means for stirring the liquid in the tank in the form of a rotatable shaft (not shown in the drawings) which extends through seals in the tank wall above the maximum liquid level in the tank, the shaft being angled so that its inner lower-end, which is provided with blades or paddles, is below the liquid level. A motor positioned externally of the tank drives the shaft to stir the tank contents.

A pressure gauge 54 mounted on the lid 14 of the tank 10 monitors the pressure within the tank 10 and gives a visual indication thereof.

The pump 26 and the distributor valve 36 are the components of the apparatus which are most likely to leak. In a conventional system these components are exposed and a leak in either is extremely inconvenient. Where the reagent in question is not a safety hazard the leak caused a mess which must be dealt with and results in wastage. However where the reagent is a safety hazard (as is the case with isocyanate) then a leak necessitates taking the system out of service, clearing unprotected personnel from the area, and repair or replacement of the leaking component even though the component may be capable of satisfactory continued operation. In the apparatus described above the pump and distribution valve are not rendered leak-free but the undesirable effects of leakage are minimized. Thus leakage is contained by the tank and provided that the cause of the leakage is not prejudicial to normal operation then normal operation can continue even when hazardous reagents are being supplied. In some applications a slight leakage has no effect upon pump output pressure and can be beneficial in lubricating seal components. Where the reagent is hazardous this could not be tolerated with known systems since the leak would be into the environment. When servicing of the components is needed then by virtue of their mounting on the lid 14 liquids draining therefrom are received by the tank and do not contaminate the area around them as is the case in known systems.

If it is necessary to carry out maintenance work on the inside of the tank 10 or on the parts of the system mounted on the underside of the lid 14 and arranged to be positioned within the tank 10 when the tank 10 is in use, the nuts and bolts used to secure the lid 14 to the body 12 are removed after having reduced the pressure within the tank 10. Once the lid 14 is no longer secured to the body 12 by the nuts and bolts, compressed air is supplied to the pneumatic rams 44 to raise the lid 14. Once the lid 14 is in its raised position, an engineer has easy access to all of the parts of the system which are mounted on the underside of the lid 14 of the tank 10. A perforated plate is positioned within the body 12 above the intended maximum level of the reagent so that if, during maintenance of the tank 10, anything is dropped into the tank 10, it can be retrieved easily without having to drain the reagent from the tank 10. After maintenance work has been completed, the compressed air supply is removed from the rams 44, thus lowering the lid 14 to its closed position. The lid 14 is then re-secured to the body of the tank by the nuts and bolts and operation of the supply system may then continue as before.

In an alternative embodiment, the lid 14 is secured to the body 12 of the tank 10 by means of clamps. Also, other measuring or monitoring devices may be mounted on the lid 14 of the tank. Depending upon the application one, two, or more than two supply systems may be used in conjunction. The three way valve may not be required in some systems, where for example, it is not envisaged that the chemical will need to be recycled, or distributed to more than one position.

The electric motor 27 driving the pump 26 is conveniently a three phase a.c. motor the speed of which can be controlled by an a.c. converter which alters the a.c. frequency. Thus a fixed output pump 26 can be utilized and the actual output of the pump in use is controlled by varying the a.c. frequency of the supply to the motor 27 to vary its speed. Control over motor speed can be effected by the microprocessor control unit mentioned above, and control can be performed in a closed-loop mode. Sensors monitor the output flow from the pump at a predetermined desired pressure and the control unit compares the flow with that which is required to achieve the desired result and adjusts the motor speed accordingly.

I claim:

1. A supply system for liquids comprising:

a storage tank for containing a supply of liquid to be dispensed;

an opening in said storage tank;

a lid having an outer side and an underside and movably mounted for movement relative to said tank between a closed position wherein said underside of said lid engages said opening for sealing said tank and an open position wherein said lid is in relative spaced relation with respect to said opening so that the interior of said tank and said underside of said lid are accessible; and a pump mounted on said underside of said lid for pumping liquid in said storage tank to associated dispensing equipment outside of said storage tank, so that in use said lid sealingly closes said opening in said storage tank and said pump is housed within said interior of said storage tank and any leakage from said pump remains in said storage tank.

2. The supply system as claimed in claim 1 wherein:

said pump is mounted on said underside of said lid so that said pump is above the intended highest level of liquid in said storage tank when said lid is in said closed position.

3. The supply system as claimed in claim 1 and further comprising:

a pump motor mounted on said outer side of said lid and operatively connected to said pump for driving said pump.

4. The supply system as claimed in claim 1 and further comprising:

a lifting mechanism operatively connected to said lid for moving said lid from said closed position to said open position.

5. The supply system as claimed in claim 4 wherein:

said lifting mechanism supports said lid in said open position to facilitate access to components positioned on said underside of said lid.

6. The supply system as claimed in claim 1 and further comprising:

a filter mounted on said lid and operatively connected to said system so that liquid within said storage tank passes through said filter before reaching said pump.

7. The supply system as claimed in claim 1 and further comprising:

a heat exchanger mounted on said lid and operatively connected in said system so that liquid to be dispensed passes through said heat exchanger before entering said storage tank.

8. The supply system as claimed in claim 1 and further comprising:

an outlet on said pump;

a distribution valve mounted on said underside of said lid so that in said closed position of said lid said valve is disposed within said storage tank;

an inlet on said valve communicating with said outlet of said pump;

valve motor means mounted on said outer side of said lid and operatively connected to said valve for operating said valve; and pump drive means operatively connected to said pump for driving said pump.

9. The supply system as claimed in claim 8 and further comprising:

a first outlet on said valve;

a heat exchanger operatively connected to said first outlet of said valve and said tank to provide a recirculation path for said liquid; and a least one further outlet on said valve communicating with respective associated dispensing equipment.

10. A supply system for liquids comprising:

a storage tank for containing a supply of liquid to be dispensed;

a pump housed within the interior of said storage tank for pumping liquid in said storage tank from said storage tank to associated dispensing equipment, so that liquid leaked from said pump remains within said storage tank;

an outlet on said pump;

a distribution valve disposed within said storage tank and having an inlet communicating with said outlet of said pump;

a valve motor drive means mounted externally of said tank and operatively connected to said valve for operating said valve; and pump drive means operatively connected to said pump for driving said pump.

11. A supply system for supplying a liquid reagent from a storage tank to a dispensing head comprising:

a storage tank having an opening therein for storing liquid to be dispensed at a predetermined pressure;

a lid engageable with said opening and having an underside and an outer side;

lid moving means operatively connected to said lid for moving said lid between a closed position wherein said underside of said lid is sealingly engaged with said opening and an open position wherein said lid is relatively spaced with respect to said opening facilitating access to the interior of said storage tank and said underside of said lid;

a pump mounted on said underside of said lid so that said pump is within said interior of said storage tank in use when said lid is in said closed position, said pump comprising a casing and a pump outlet in said casing;

a pump motor mounted on said outer side of said lid and operatively connected to said pump for driving said pump to supply liquid from said tank to said dispensing head;

a distribution valve mounted on said underside of said lid so that said distribution valve is within said interior of said tank when said lid is in said closed position;

valve motor means mounted on said outer side of said lid and operatively connected to said distribution valve for operating said distribution valve, said distribution valve being operatively connected to said pump outlet for controlling distribution of said liquid from said pump outlet; and means for ensuring that said pump casing is supplied with said liquid at a pressure at least equal to the pressure on said liquid in said storage tank.

12. A supply system for liquids comprising:

a storage tank for containing a supply of liquid to be dispensed;

means for pressurizing liquid in said storage tank;

a pump for pumping liquid in said storage tank to associated dispensing equipment, said pump being housed within the interior of said storage tank so that liquid leaking from said pump remains in said storage tank, said pump comprising a casing and a pumping mechanism within said casing;

means for driving said pump;

means for ensuring that said casing is filled with said liquid at a pressure at least equal to the pressure on said liquid in said storage tank; and recirculating means for recirculating liquid pumped and not dispensed at said associated dispensing equipment back to the interior of said tank.

13. The supply system as claimed in claim 12 and further comprising:

a filter operatively connected to said system so that liquid to be dispensed passes through said filter before reaching said pump.

14. The supply system as claimed in claim 12 and further comprising:

a heat exchanger operatively connected to said supply system so that liquid to be dispensed passes through said heat exchanger before entering said storage tank.

15. The supply system as claimed in claim 12 and further comprising:

safety means for limiting pressure in said storage tank.

16. The supply system as claimed in claim 12 and further comprising:

a liquid return line operatively connected with said pump casing for returning liquid from said dispensing equipment to said storage tank.

* * * * *